US011456098B2

(12) United States Patent
Nakamura

(10) Patent No.: US 11,456,098 B2
(45) Date of Patent: Sep. 27, 2022

(54) INSULATOR-COATED SOFT MAGNETIC POWDER, METHOD FOR PRODUCING INSULATOR-COATED SOFT MAGNETIC POWDER, POWDER MAGNETIC CORE, MAGNETIC ELEMENT, ELECTRONIC DEVICE, AND VEHICLE

(71) Applicant: Seiko Epson Corporation, Tokyo (JP)

(72) Inventor: Atsushi Nakamura, Hachinohe (JP)

(73) Assignee: Seiko Epson Corporation

( * ) Notice: Subject to any disclaimer, the term of this patent is extended or adjusted under 35 U.S.C. 154(b) by 172 days.

(21) Appl. No.: 16/286,856

(22) Filed: Feb. 27, 2019

(65) Prior Publication Data

US 2019/0267170 A1 Aug. 29, 2019

(30) Foreign Application Priority Data

Feb. 28, 2018 (JP) ..... 2018-035894

(51) Int. Cl.

| | |
|---|---|
| ***H01F 7/02*** | (2006.01) |
| ***H01F 3/08*** | (2006.01) |
| ***H01F 1/24*** | (2006.01) |
| ***H01F 1/33*** | (2006.01) |
| ***H01F 1/147*** | (2006.01) |
| ***B22F 1/16*** | (2022.01) |
| *B22F 9/08* | (2006.01) |

(52) U.S. Cl.

CPC ..... *H01F 1/24* (2013.01); *B22F 1/16* (2022.01); *H01F 1/147* (2013.01); *H01F 1/33* (2013.01); *H01F 3/08* (2013.01); *B22F 2009/0828* (2013.01); *B22F 2301/35* (2013.01); *B22F 2302/20* (2013.01); *B22F 2302/25* (2013.01); *B22F 2303/01* (2013.01); *B22F 2998/10* (2013.01)

(58) Field of Classification Search

None

See application file for complete search history.

(56) References Cited

U.S. PATENT DOCUMENTS

| | | | |
|---|---|---|---|
| 5,348,800 | A | 9/1994 | Moro et al. |
| 5,756,162 | A | 5/1998 | Bae et al. |

(Continued)

FOREIGN PATENT DOCUMENTS

| | | | |
|---|---|---|---|
| CN | 105355356 | A | 2/2016 |
| CN | 106852099 | A | 6/2017 |

(Continued)

*Primary Examiner* — Ronak C Patel

(74) *Attorney, Agent, or Firm* — Harness, Dickey & Pierce, P.L.C.

(57) ABSTRACT

An insulator-coated soft magnetic powder includes core particles each of which includes a base portion containing a soft magnetic material and an oxide film provided on the surface of the base portion and containing an oxide of an element contained in the soft magnetic material, ceramic particles which are provided on the surface of each of the core particles and have an insulating property, and a glass material which is provided on the surface of each of the core particles, has an insulating property, and contains at least one type of phosphorus oxide, bismuth oxide, zinc oxide, boron oxide, tellurium oxide, and silicon oxide as a main component, wherein the ceramic particles are included in a proportion of 100 vol % or more and 500 vol % or less of the glass material.

7 Claims, 11 Drawing Sheets

(56) References Cited

U.S. PATENT DOCUMENTS

| | | | | |
|---|---|---|---|---|
| 2002/0014280 | A1 | 2/2002 | Moro | |
| 2009/0007418 | A1* | 1/2009 | Edo | H01F 41/0246 29/609 |
| 2012/0001719 | A1 | 1/2012 | Oshima et al. | |
| 2014/0138570 | A1* | 5/2014 | Otsuka | H01F 1/24 252/62.55 |
| 2016/0240294 | A1* | 8/2016 | Inagaki | H01F 41/0246 |
| 2017/0063172 | A1* | 3/2017 | Shiohara | H02K 1/146 |
| 2017/0155288 | A1 | 6/2017 | Lee et al. | |
| 2017/0162307 | A1* | 6/2017 | Ishida | H01F 41/0246 |

FOREIGN PATENT DOCUMENTS

| | | | |
|---|---|---|---|
| JP | S58-135172 | A | 8/1983 |
| JP | H05-109520 | A | 4/1993 |
| JP | H09-125108 | A | 5/1997 |
| JP | 2001-307914 | A | 11/2001 |
| JP | 2002-015912 | A | 1/2002 |
| JP | 2003-068550 | A | 3/2003 |
| JP | 2008-004864 | A | 1/2008 |
| JP | 2009-188270 | A | 8/2009 |
| JP | 2010-236018 | A | 10/2010 |
| JP | 2011-035003 | A | 2/2011 |
| JP | 2012-129217 | A | 7/2012 |
| JP | 2012-230948 | A | 11/2012 |
| JP | 2015-095570 | A | 5/2015 |

* cited by examiner

INSULATOR-COATED SOFT MAGNETIC POWDER, METHOD FOR PRODUCING INSULATOR-COATED SOFT MAGNETIC POWDER, POWDER MAGNETIC CORE, MAGNETIC ELEMENT, ELECTRONIC DEVICE, AND VEHICLE

BACKGROUND

1. Technical Field

The present invention relates to an insulator-coated soft magnetic powder, a method for producing an insulator-coated soft magnetic powder, a powder magnetic core, a magnetic element, an electronic device, and a vehicle.

2. Related Art

Recently, reduction in size and weight of a mobile device such as a notebook personal computer has advanced. However, in order to achieve both reduction in size and enhancement of performance at the same time, it is necessary to increase the frequency of a switched-mode power supply. At present, the driving frequency of a switched-mode power supply has been increased to several hundred kilo hertz or more. However, accompanying this, a magnetic element such as a choke coil or an inductor built in a mobile device also needs to be adapted to cope with the increase in the frequency.

However, in the case where the driving frequency of such a magnetic element is increased, there arises a problem that a Joule loss (eddy current loss) due to an eddy current is significantly increased in a magnetic core included in each magnetic element. Therefore, particles of a soft magnetic powder contained in the magnetic core are insulated from one another so as to reduce the eddy current loss.

For example, JP-A-2001-307914 (Patent Document 1) discloses a magnetic powder for a powder magnetic core composed of a soft magnetic powder and an inorganic binder component which covers the soft magnetic powder, wherein the inorganic binder component is composed of 10 to 95 wt % of liquid glass and 5 to 90 wt % of an insulating oxide powder. Such a magnetic powder for a powder magnetic core ensures an insulating property due to the intervention of the inorganic binder component, and can also be annealed at a high temperature, and therefore can produce a powder magnetic core from which molding strain is removed.

However, recently, it has been demanded that strain remaining in a soft magnetic powder be more reliably removed by performing a heat treatment at a particularly high temperature exceeding 1000° C. By doing this, the hysteresis loss is reduced.

Even in the case of a soft magnetic metal particle powder capable of being fired at a high temperature as described in Patent Document 1, in a heat treatment at a particularly high temperature exceeding 1000° C., aggregation between metal particles may sometimes proceed. When such aggregation occurs, characteristics as a powder are degraded, and therefore, the moldability of the soft magnetic metal particle powder is deteriorated. Therefore, when compaction molding is performed, sufficient filling performance cannot be obtained, and the magnetic characteristics of the resulting powder magnetic core are deteriorated.

Therefore, an insulator-coated soft magnetic powder which hardly degrades its characteristics as a powder even if it is subjected to a heat treatment at a high temperature has been demanded.

SUMMARY

An advantage of some aspects of the invention is to solve the above-mentioned problem and the invention can be implemented as the following application example.

An insulator-coated soft magnetic powder according to an application example of the invention includes core particles each of which includes a base portion containing a soft magnetic material and an oxide film provided on the surface of the base portion and containing an oxide of an element contained in the soft magnetic material, ceramic particles which are provided on the surface of each of the core particles and have an insulating property, and a glass material which is provided on the surface of each of the core particles, has an insulating property, and contains at least one type of phosphorus oxide, bismuth oxide, zinc oxide, boron oxide, tellurium oxide, and silicon oxide as a main component, wherein the ceramic particles are included in a proportion of 100 vol % or more and 500 vol % or less of the glass material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an insulator-coated soft magnetic powder, a method for producing an insulator-coated soft magnetic powder, a powder magnetic core, a magnetic element, an electronic device, and a vehicle according to the invention will be described in detail based on preferred embodiments shown in the accompanying drawings.

Insulator-Coated Soft Magnetic Powder

First, an insulator-coated soft magnetic powder according to this embodiment will be described.

Figure 1:
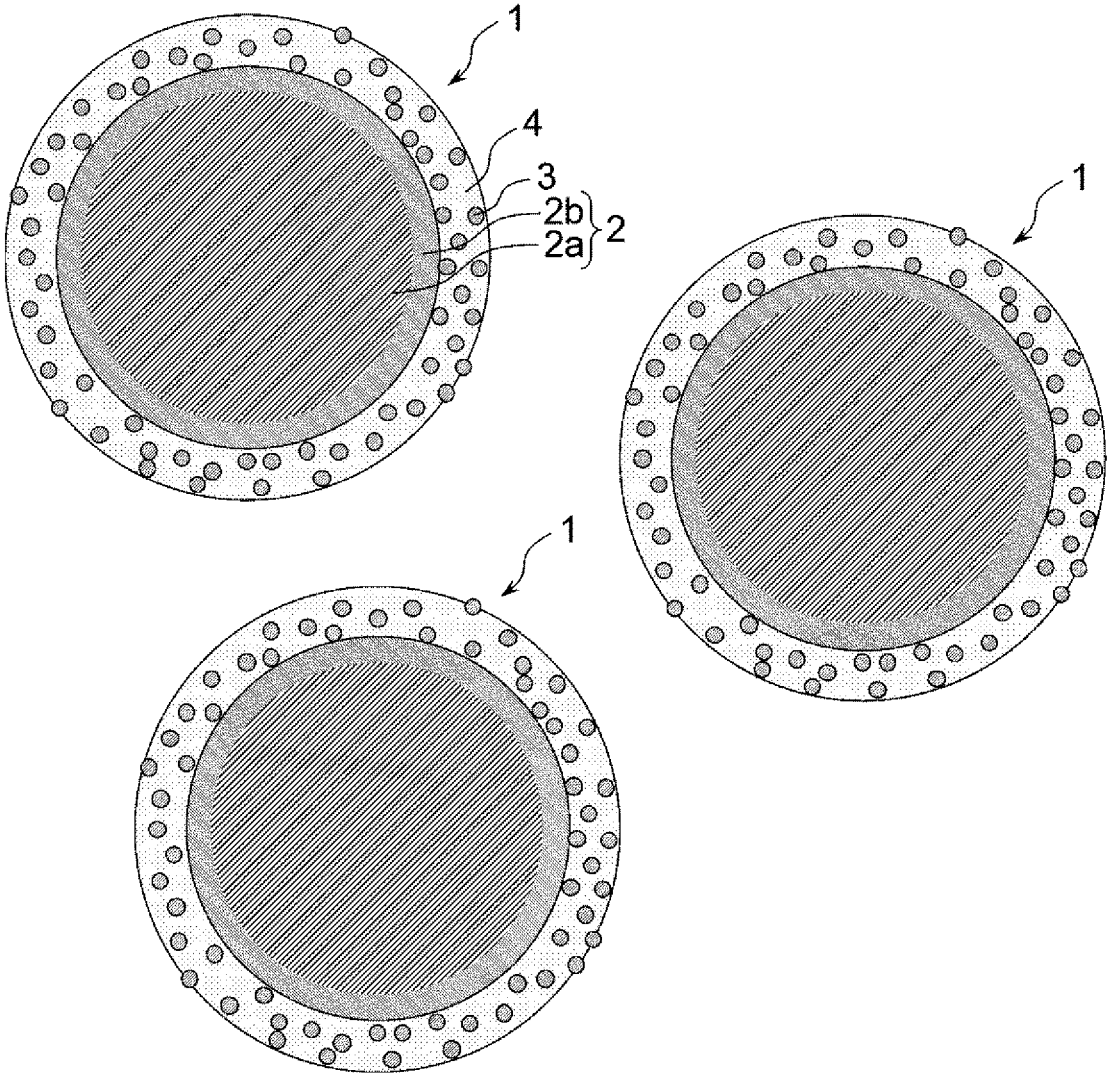
FIG. 1 is a cross-sectional view showing one particle of an embodiment of an insulator-coated soft magnetic powder according to the invention.

FIG. 1 is a cross-sectional view showing one particle of an embodiment of an insulator-coated soft magnetic powder according to the invention. In the following description, the "one particle of an insulator-coated soft magnetic powder" is also referred to as "an insulator-coated soft magnetic particle".

An insulator-coated soft magnetic particle 1 shown in FIG. 1 includes a core particle 2 which includes a base portion 2*a* containing a soft magnetic material and an oxide film 2*b* provided on the surface of the base portion 2*a*, ceramic particles 3 which are provided on the surface of the core particle 2 and have an insulating property, and a glass material 4 which is provided on the surface of the core particle 2, has an insulating property, and contains at least one type of phosphorus oxide, bismuth oxide, zinc oxide, boron oxide, tellurium oxide, and silicon oxide as a main component. The oxide film 2*b* contains an oxide of an element contained in the soft magnetic material. The ceramic particles 3 are included in a proportion of 100 vol % or more and 500 vol % or less of the glass material 4.

In such an insulator-coated soft magnetic particle 1, an insulating property between particles is ensured by providing the ceramic particles 3 on the surface of the core particle 2. Therefore, by molding such insulator-coated soft magnetic particles 1 into a predetermined shape, a powder magnetic core capable of realizing a magnetic element having a low eddy current loss can be produced.

In particular, by the presence of the ceramic particles 3 on the surfaces of the insulator-coated soft magnetic particles 1, the contact between the core particles 2 is more reliably suppressed. According to this, the insulation resistance between the core particles 2 is ensured, and the eddy current loss can be reduced.

Further, even if such insulator-coated soft magnetic particles 1 are subjected to, for example, a heat treatment at a temperature as high as 1000° C., characteristics as a powder are hardly degraded. That is, even if the insulator-coated soft magnetic particles 1 are subjected to a heat treatment at a high temperature, aggregation, adhesion, or the like is less likely to occur, and the insulator-coated soft magnetic particles 1 have favorable powder characteristics such as flowability. As a result, the insulator-coated soft magnetic particles 1 can produce a green compact having favorable magnetic characteristics.

Method for Producing Insulator-Coated Soft Magnetic Powder

Next, a method for producing the insulator-coated soft magnetic particles 1 shown in FIG. 1 (a method for producing an insulator-coated soft magnetic powder according to this embodiment) will be described.

The method for producing the insulator-coated soft magnetic particles 1 includes a step of mixing ceramic particles 3 having an insulating property with a glass material 4 having an insulating property and containing at least one type of phosphorus oxide, bismuth oxide, zinc oxide, boron oxide, tellurium oxide, and silicon oxide as a main component and also performing granulation, thereby obtaining insulating particles 5, and a step of mixing core particles 2 each of which includes a base portion 2*a* containing a soft magnetic material and an oxide film 2*b* provided on the surface of the base portion 2*a* and containing an oxide of an element contained in the soft magnetic material with the insulating particles 5 and also performing granulation, thereby obtaining composite particles. Hereinafter, the respective steps will be sequentially described.

FIGS. 2 to 5 are longitudinal cross-sectional views each showing a structure of a powder coating device to be used in the method for producing an insulator-coated soft magnetic powder according to the embodiment.

[1]

Figure 2:
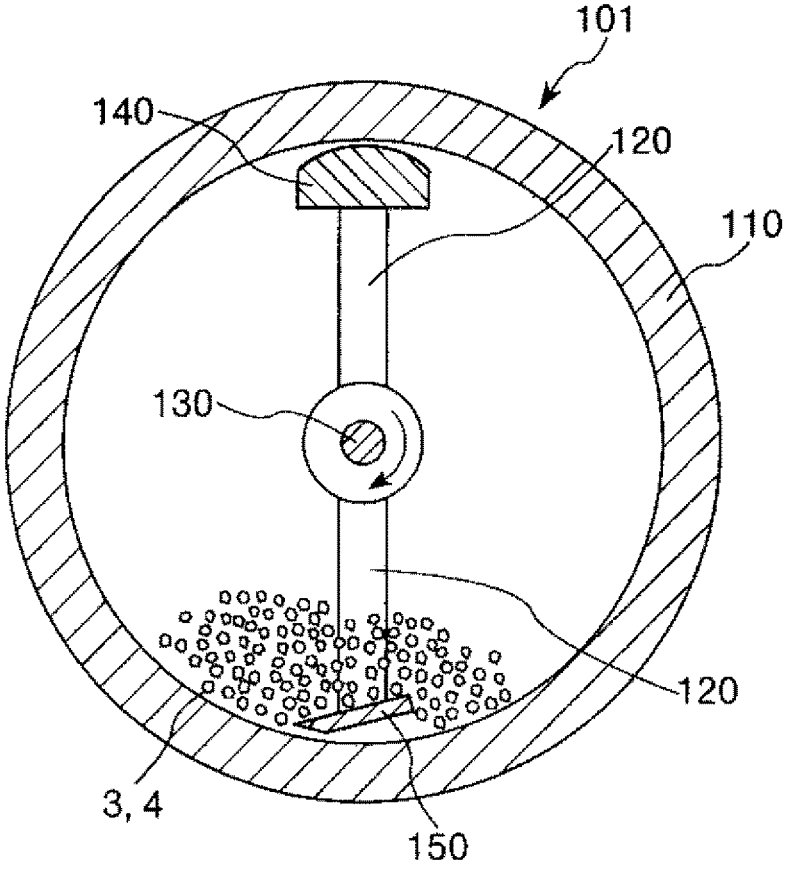
FIG. 2 is a longitudinal cross-sectional view showing a structure of a powder coating device to be used in a method for producing an insulator-coated soft magnetic powder according to an embodiment.

[1-1] First, core particles 2, ceramic particles 3, and a glass material 4 are prepared (see FIG. 2).

The core particles 2 are particles containing a soft magnetic material.

Each of the core particles 2 according to the embodiment includes a base portion 2*a* containing a soft magnetic material and an oxide film 2*b* provided on the surface of the base portion 2*a* and containing an oxide of an element contained in the soft magnetic material.

In such a core particle 2, the oxide film 2*b* having lower electrical conductivity than the core portion 2*a* is provided, and therefore, in the core particle 2 itself, the insulation resistance between the core particles 2 is increased. According to this, in a green compact obtained by compacting the insulator-coated soft magnetic particles 1, the eddy current loss is further reduced.

Examples of the soft magnetic material contained in the base portion 2*a* include pure iron, various types of Fe-based alloys such as silicon steel (an Fe—Si-based alloy), permalloy (an Fe—Ni-based alloy), permendur (an Fe—Co-based alloy), an Fe—Si—Al-based alloy such as Sendust, an Fe—Cr—Si-based alloy, and an Fe—Cr—Al-based alloy, and other than these, various types of Ni-based alloys, and various types of Co-based alloys. Among these, various types of Fe-based alloys are preferably used from the viewpoint of magnetic characteristics such as magnetic permeability and magnetic flux density, and productivity such as cost.

The crystalline property of the soft magnetic material is not particularly limited, and the soft magnetic material may be crystalline or non-crystalline (amorphous) or microcrystalline (nanocrystalline).

The base portion 2*a* preferably contains the soft magnetic material as a main material, and may contain an impurity other than this.

The oxide contained in the oxide film 2*b* is an oxide of an element contained in the soft magnetic material contained in the base portion 2*a*. Therefore, in the case where the soft magnetic material contained in the base portion 2*a* is, for example, an Fe—Cr—Si-based alloy, the oxide film 2*b* may contain at least one type of iron oxide, chromium oxide, and silicon oxide. In some cases, the Fe—Cr—Si-based alloy contains an element (another element) other than the main element such as Fe, Cr, or Si, however, in such a case, the oxide film 2*b* may contain an oxide of another element in place of the oxide of the main element, or may contain both the oxide of the main element and the oxide of another element.

Examples of the oxide contained in the oxide film 2*b* include iron oxide, chromium oxide, nickel oxide, cobalt oxide, manganese oxide, silicon oxide, boron oxide, phosphorus oxide, aluminum oxide, magnesium oxide, calcium oxide, zinc oxide, titanium oxide, vanadium oxide, and cerium oxide, and among these, one type or two or more types are contained.

The oxide film 2*b* preferably contains a glass forming component or a glass stabilizing component among these. According to this, for example, in the case where the ceramic particle 3 contains an oxide, the oxide film 2*b* acts to promote the adhesion of the ceramic particle 3 to the oxide film 2*b*. That is, the glass forming component or the glass stabilizing component generates an interaction such as vitrification between the component and the oxide contained in the ceramic particle 3 and promotes the adhesion of the ceramic particle 3 to the oxide film 2*b* more firmly. As a result, the ceramic particle 3 is less likely to fall off from the surface of the core particle 2, and thus, the insulator-coated soft magnetic particle 1 which hardly deteriorates its insulating property and therefore has high reliability is obtained.

Further, by vitrification, for example, even in an environment in which a high-temperature state and a low-temperature state are repeated, a gap is hardly generated between the core particle 2 and the ceramic particle 3. Therefore, for example, a decrease in insulating property due to penetration of water or the like in a gap can be suppressed. Accordingly, the insulator-coated soft magnetic particle 1 having favorable high temperature resistance is obtained also from this viewpoint.

Examples of the glass forming component include silicon oxide, boron oxide, and phosphorus oxide.

Examples of the glass stabilizing component include aluminum oxide.

Among these oxides, the oxide film 2*b* preferably contains silicon oxide. Silicon oxide is the glass forming component, and therefore readily generates an interaction such as vitrification between the component and the oxide contained in the ceramic particle 3 or the glass material 4. Due to this, the ceramic particle 3 or the glass material 4 is adhered to the oxide film 2*b* more firmly, and thus, the insulator-coated soft magnetic particle 1 which hardly deteriorates its insulating property and therefore has high reliability is obtained.

The presence or absence of the oxide film 2*b* can be specified according to the oxygen atom concentration distribution in a direction toward the center from the surface of the core particle 2 (hereinafter referred to as "depth direction"). That is, when the oxygen atom concentration distribution in the depth direction of the core particle 2 is obtained, the presence or absence of the oxide film 2*b* can be evaluated according to the distribution.

Such a concentration distribution can be obtained by, for example, a depth direction analysis using Auger electron spectroscopy in combination with sputtering. In this analysis, the core particle 2 is irradiated with an electron beam while allowing ions to collide with the surface of the core particle 2 so as to gradually peel off an atomic layer, and an atom is identified and quantitatively determined based on the kinetic energy of an Auger electron emitted from the core particle 2. Therefore, by converting a time required for the sputtering into the thickness of the atomic layer peeled off by the sputtering, a relationship between the depth from the surface of the core particle 2 and the compositional ratio can be determined.

A position where the depth from the surface of the core particle 2 is 300 nm can be regarded as sufficiently deep from the surface, and therefore, the oxygen concentration at that position can be regarded as the oxygen concentration in an inner region of the core particle 2.

In that case, by calculating the relative amount with respect to the oxygen concentration in the inner region from the oxygen concentration distribution in the depth direction from the surface of the core particle 2, the thickness of the oxide film 2*b* can be calculated. Specifically, in the core particle 2, oxidation proceeds toward the inner region from the surface in the production process, however, if the oxygen concentration obtained by the above-mentioned analysis is within the range of ±50% of the oxygen concentration in the inner region, the oxide film 2*b* can be regarded not to be present in the place where the analysis is performed. On the other hand, if the oxygen concentration obtained by the above-mentioned analysis is higher than +50% of the oxygen concentration in the inner region, the oxide film 2*b* can be regarded to be present in the place where the analysis is performed.

Therefore, by repeating such evaluation, the thickness of the oxide film 2*b* can be determined. It is not necessary to provide the oxide film 2*b* on the entire surface of the base portion 2*a*, and there may be a region where the base portion 2*a* is exposed.

The type of the oxide contained in the oxide film 2*b* can be specified by, for example, X-ray photoelectron spectroscopy or the like.

The thickness of the oxide film 2*b* measured in this manner is preferably 5 nm or more and 200 nm or less, more preferably 10 nm or more and 100 nm or less. According to this, the core particle 2 itself has an insulating property. Therefore, the insulator-coated soft magnetic particle 1 having a higher insulating property is obtained in cooperation with the ceramic particle 3 and the glass material 4.

Further, according to the oxide film 2*b* having such a thickness, the adhesion strength between the oxide film 2*b* and the ceramic particle 3, and the adhesion strength between the oxide film 2*b* and the glass material 4 can be further enhanced. Accordingly, the ceramic particle 3 or the glass material 4 is far less likely to fall off from the surface of the core particle 2, and thus, the reliability of the insulator-coated soft magnetic particle 1 can be further improved.

When the thickness of the oxide film 2*b* is less than the above lower limit, since the thickness of the oxide film 2*b* is small, the insulating property between the insulator-coated soft magnetic particles 1 may be deteriorated, or the ceramic particle 3 or the glass material 4 may be more likely to fall off from the oxide film 2*b*. On the other hand, when the thickness of the oxide film 2*b* is more than the above upper limit, since the thickness of the oxide film 2*b* is too thick, the volume of the base portion 2*a* is relatively decreased, and therefore, the magnetic characteristics of a green compact obtained by compacting the insulator-coated soft magnetic particles 1 may be deteriorated.

Such core particles 2 may be produced by any method, but is produced by, for example, any of various types of powdering methods such as an atomization method (for example, a water atomization method, a gas atomization method, a spinning water atomization method, etc.), a reducing method, a carbonyl method, and a pulverization method.

Among these, as the core particles 2, core particles produced by a water atomization method or a spinning water atomization method (a water atomized powder or a spinning water atomized powder) are preferably used. By using a water atomization method and a spinning water atomization method, an extremely fine powder can be efficiently produced. Further, the shape of each particle of the obtained powder becomes close to a complete sphere, and therefore, the ease of rolling of the core particles 2 is improved, and an effect that the ceramic particle 3 and the glass material 4 are easily adhered thereto occurs. Moreover, in the water atomization method and the spinning water atomization method, powdering is performed by utilizing contact between a molten metal and water, and therefore, the oxide film 2*b* having a moderate film thickness is formed on the surface of the core particle 2. As a result, the core particle 2 including the oxide film 2*b* having a moderate film thickness can be efficiently produced.

The thickness of the oxide film 2*b* can be adjusted by, for example, a cooling rate of a molten metal when producing the core particle 2. Specifically, by decreasing the cooling rate, the thickness of the oxide film 2*b* can be increased.

The ceramic particle 3 is a particle containing a ceramic material.

Examples of the ceramic material include aluminum oxide (for example, $Al_2O_3$), manganese oxide, titanium oxide, zirconium oxide, silicon oxide, iron oxide, potassium oxide, sodium oxide, calcium oxide, chromium oxide, boron nitride, silicon nitride, and silicon carbide, and a material containing one type or two or more types among these is used.

The ceramic particle 3 preferably contains aluminum oxide, silicon oxide, or zirconium oxide among these. These have a relatively high hardness and a relatively high softening point (melting point). Therefore, the insulator-coated soft magnetic particles 1 including such ceramic particles 3 easily maintain the particulate shape of the ceramic particle 3 even when a compaction load is applied thereto. Due to this, the insulator-coated soft magnetic particles 1 which hardly deteriorate the insulating property between particles even if the particles are compacted, can be compaction molded at a high pressure, and thus can produce a green compact having favorable magnetic characteristics are obtained. Further, the insulator-coated soft magnetic particles 1 including such ceramic particles 3 have high heat resistance. Therefore, the insulator-coated soft magnetic particles 1 which hardly deteriorate the powder characteristics such as flowability even if the particles are subjected to a heat treatment at a high temperature can be realized.

As the insulating material, a material having a relatively high hardness is preferably used. Specifically, a material having a Mohs hardness of 6 or more is preferred, and a material having a Mohs hardness of 6.5 or more and 9.5 or less is more preferred. According to such an insulating material, the particulate shape of the ceramic particle 3 is easily maintained even when a compression load is applied thereto. Therefore, the insulator-coated soft magnetic particles 1 which hardly deteriorate the insulating property between particles even if the particles are compacted, can be compaction molded at a high pressure, and thus can produce a green compact having favorable magnetic characteristics are obtained.

The insulating material having such a Mohs hardness has a relatively high softening point, and therefore has high heat resistance. Therefore, the insulator-coated soft magnetic particles 1 which hardly deteriorate the powder characteristics such as flowability even if the particles are subjected to a heat treatment at a high temperature can be realized.

The average particle diameter of the ceramic particles 3 is not particularly limited, but is preferably 1 nm or more and 500 nm or less, more preferably 5 nm or more and 300 nm or less, further more preferably 8 nm or more and 100 nm or less. By setting the average particle diameter of the ceramic particles 3 within the above range, when the ceramic particles 3 are closely adhered to the core particles 2 in the below-mentioned step, a necessary and sufficient pressure can be applied to the ceramic particles 3. As a result, the ceramic particles 3 can be closely adhered to the core particles 2 favorably.

The average particle diameter of the ceramic particles 3 is a particle diameter at a cumulative frequency of 50% from a small diameter side in a cumulative frequency distribution on a mass basis obtained by a laser diffraction-type particle size distribution analyzer.

Further, the average particle diameter of the ceramic particles 3 is preferably about 0.1% or more and 20% or less, more preferably about 0.3% or more and 10% or less of the average particle diameter of the core particles 2. When the average particle diameter of the ceramic particles is within the above range, the insulator-coated soft magnetic particles 1 have a sufficient insulating property, and when a powder magnetic core is produced by pressing and molding an aggregate of the insulator-coated soft magnetic particles 1, a significant decrease in occupancy of the core particles 2 in the powder magnetic core is prevented. As a result, the insulator-coated soft magnetic particles 1 capable of producing a powder magnetic core which has a low eddy current loss and excellent magnetic characteristics such as magnetic permeability and magnetic flux density are obtained.

The average particle diameter of the core particles 2 is preferably 1 μm or more and 50 μm or less, more preferably 2 μm or more and 30 μm or less, further more preferably 3 μm or more and 15 μm or less. When the average particle diameter of the core particles 2 is within the above range, the insulator-coated soft magnetic particles 1 capable of producing a powder magnetic core which has a low eddy current loss and excellent magnetic characteristics such as magnetic permeability and magnetic flux density are obtained.

The addition amount of the ceramic particles 3 is preferably 0.1 mass % or more and 5 mass % or less, more preferably 0.3 mass % or more and 3 mass % or less of the core particles 2. When the addition amount of the ceramic particles 3 is within the above range, the insulator-coated soft magnetic particles 1 have a sufficient insulating property, and when a powder magnetic core is produced by pressing and molding an aggregate of the insulator-coated soft magnetic particles 1, a significant decrease in occupancy of the core particles 2 in the powder magnetic core is prevented. As a result, the insulator-coated soft magnetic particles 1 capable of producing a powder magnetic core which has a low eddy current loss and excellent magnetic characteristics such as magnetic permeability and magnetic flux density are obtained.

The ceramic particles 3 may be subjected to a surface treatment as needed. Examples of the surface treatment include a hydrophobic treatment. By performing a hydrophobic treatment, adsorption of water onto the ceramic particles 3 can be suppressed. Therefore, deterioration or the like of the core particles 2 due to water can be suppressed. In addition, the hydrophobic treatment also has an effect of suppressing aggregation of the insulator-coated soft magnetic particles 1.

Examples of the hydrophobic treatment include trimethylsilylation and arylation (for example, phenylation). In the trimethylsilylation, for example, a trimethylsilylating agent such as trimethylchlorosilane or the like is used. In the arylation, for example, an arylating agent such as an aryl halide is used.

The glass material 4 contains at least one type of phosphorus oxide ($P_2O_5$), bismuth oxide ($Bi_2O_3$), zinc oxide (ZnO), boron oxide ($B_2O_3$), tellurium oxide ($TeO_2$), and silicon oxide ($SiO_2$) as a main component. Such a glass material 4 has favorable heat resistance and is relatively rich in flexibility. Therefore, the glass material 4 is interposed between the core particle 2 and the ceramic particle 3, and contributes to fixation of both particles. As a result, the ceramic particle 3 can be closely adhered to the surface of the core particle 2 more firmly.

The glass material 4 may contain an arbitrary glass component other than the above-mentioned main component. Examples of such a component include $B_2O_3$, $SiO_2$, $Al_2O_3$, ZnO, SnO, PbO, $Li_2O$, $Na_2O$, $K_2O$, MgO, CaO, SrO, BaO, $Gd_2O_3$, $Y_2O_3$, $La_2O_3$, and $Yb_2O_3$, and among these, one type or two or more types are used.

The "main component" refers to a component whose content (mass ratio) is the largest in the glass material 4. Further, in this specification, for example, the glass material containing $P_2O_5$ as the main component is also referred to as "$P_2O_5$-based glass".

The softening point of the glass material 4 is preferably 650° C. or lower, more preferably 250° C. or higher and 600° C. or lower, further more preferably 300° C. or higher and 500° C. or lower. When the softening point of the glass material 4 is within the above range, even if the glass material 4 is subjected to a heat treatment at a high temperature, significant deformation of the glass material is suppressed. Accordingly, the insulator-coated soft magnetic particles 1 which hardly deteriorate the powder characteristics such as flowability even if the particles are subjected to a heat treatment at a high temperature can be realized.

The softening point of the glass material 4 is measured by the measurement method for the softening point specified in JIS R 3103-1:2001.

Further, to the surface of the core particle 2, other than the ceramic particle 3 or the glass material 4, an electrically non-conductive inorganic material such as a silicon material may be added. In such a case, the addition amount thereof is set to, for example, about 10 mass % or less of the insulator-coated soft magnetic particles 1.

The ceramic particles 3 are included in a proportion of 100 vol % or more and 500 vol % or less of the glass material 4.

The ceramic particle 3 has a higher hardness than the glass material 4 and also has a higher softening point (melting point) than the glass material 4. Therefore, when the ratio of the volume of the ceramic particles 3 to the volume of the glass material 4 is within the above range, the insulator-coated soft magnetic particles 1 which are less likely to cause aggregation or the like even if the particles are subjected to a heat treatment at a high temperature such as 1000° C., and hardly degrade the characteristics as a powder are obtained.

On the other hand, the glass material 4 not only enhances the insulating property of the insulator-coated soft magnetic particles 1, but also plays a role in fixing the ceramic particle 3 to the surface of the core particle 2. At this time, by optimizing the mixing ratio of the glass material 4 to the ceramic particles 3, both the function of high temperature resistance as described above of the ceramic particle 3 and the function of suppressing the fall-off of the ceramic particle 3 can be achieved. According to this, the insulator-coated soft magnetic particles 1 which can be subjected to a heat treatment at a high temperature and do not degrade the powder characteristics, and therefore, can produce a green compact having favorable magnetic characteristics are obtained.

When the ratio of the volume of the ceramic particles 3 to the volume of the glass material 4 is lower than the above lower limit, the ratio of the ceramic particles 3 becomes relatively small, and therefore, a problem such as aggregation may occur in the insulator-coated soft magnetic particles 1 when the particles are subjected to a heat treatment at a high temperature. On the other hand, when the ratio of the volume of the ceramic particles 3 to the volume of the glass material 4 exceeds the above upper limit, the ratio of the glass material 4 becomes relatively small, and therefore, the ceramic particle 3 may fall off from the surface of the core particle 2 when performing compaction molding or the like.

The ratio of the ceramic particles 3 to the glass material 4 is preferably 125 vol % or more and 450 vol % or less, more preferably 150 vol % or more and 400 vol % or less.

Further, the volume ratio of the ceramic particles to the glass material 4 in the insulator-coated soft magnetic particle 1 can be substituted by the area ratio of the ceramic particles 3 to the glass material 4 measured in the cross section of the insulator-coated soft magnetic particle 1.

Particles having an insulating property other than the ceramic particles 3 and the glass material 4 may be used together with the ceramic particles 3 and the glass material 4.

Examples of the particles having an insulating property other than the ceramic particles 3 and the glass material 4 include an electrically non-conductive inorganic material such as a silicon material.

The addition amount of the particles having an insulating property other than the ceramic particles 3 and the glass material 4 is preferably 50 mass % or less, more preferably 30 mass % or less of the total amount of the ceramic particles 3 and the glass material 4.

[1-2] Subsequently, the ceramic particles 3 and the glass material 4 are mixed and also granulation is performed. By doing this, insulating particles 5 are obtained.

When producing the insulating particles 5, a process for mixing the ceramic particles 3 and the glass material 4 and a process for granulating the mixture may be performed separately or simultaneously.

Further, the method for producing the insulating particles 5 may be a wet method or a dry method.

In the wet method, a slurry including the ceramic particles 3 and the glass material 4 is prepared, and the slurry is granulated by an arbitrary granulation method while drying the slurry. By doing this, the insulating particles 5 can be produced.

On the other hand, in the dry method, the ceramic particles 3 and the glass material 4 are pressed against each other at a high pressure, whereby granulation is performed. By doing this, the insulating particles 5 can be produced without using water or a liquid, and therefore, there is no fear that water or the like is interposed between the ceramic particle 3 and the glass material 4, and thus, the long-term durability of the insulator-coated soft magnetic particles 1 can be enhanced.

Hereinafter, the dry method will be further described.

In the dry method, a device that causes mechanical compression and friction actions on the ceramic particles 3 and the glass material 4 is used. Examples of such a device include various types of pulverizers such as a hammer mill, a disk mill, a roller mill, a ball mill, a planetary mill, and a jet mill, and various types of friction mixers such as Angmill (registered trademark), a high-speed oval mixer, a Mix Muller (registered trademark), a Jacobson mill, Mechanofusion (registered trademark), and Hybridization (registered trademark). Here, as one example, a powder coating device 101 (friction mixer) shown in FIGS. 2 and 3 including a container 110 and a chip 140 which rotates inside the container along the inner wall of the container will be described.

The powder coating device 101 includes the container 110 which has a cylindrical shape and an arm 120 which has a rod-like shape and is provided inside the container 110 along the radial direction.

The container 110 is constituted by a metal material such as stainless steel, and mechanical compression and friction actions are given to a mixture of the ceramic particles 3 and the glass material 4 fed into the container.

The glass material 4 may be in any form, and for example, the form may be any of a powder, a granule, a block, and the like.

At the center in the longitudinal direction of the arm 120, a rotating shaft 130 is inserted, and the arm 120 is provided rotatably with this rotating shaft 130 as the center of rotation. The rotating shaft 130 is provided so as to coincide with the central axis of the container 110.

In one end portion of the arm 120, the chip 140 is provided. This chip 140 has a shape with a convex curved plane and a flat plane facing the curved plane, and the curved plane faces the inner wall of the container 110, and the separation distance between this curved plane and the container 110 is set to a predetermined length. According to this, the chip 140 can rotate along the inner wall of the container 110 with the rotation of the arm 120 while maintaining a constant distance from the inner wall.

In the other end portion of the arm 120, a scraper 150 is provided. This scraper 150 is a plate-like member, and in the same manner as the chip 140, the separation distance between the scraper 150 and the container 110 is set to a predetermined length. According to this, the scraper 150 can scrape materials near the inner wall of the container 110 with the rotation of the arm 120.

The rotating shaft 130 is connected to a rotation driving device (not shown) provided outside the container 110 and thus can rotate the arm 120.

The container 110 can maintain a sealed state while driving the powder coating device 101 and can maintain the inside in a reduced pressure (vacuum) state or a state of being replaced with any of various types of gases. The gas inside the container 110 is preferably replaced with an inert gas such as nitrogen or argon. According to this, oxidation or denaturation of the ceramic particles 3 and the glass material 4 during granulation can be suppressed.

Next, a method for producing the insulating particles 5 using the powder coating device 101 will be described.

First, the ceramic particles 3 and the glass material 4 are fed into the container 110. Subsequently, the container 110 is sealed and the arm 120 is rotated.

Figure 3:
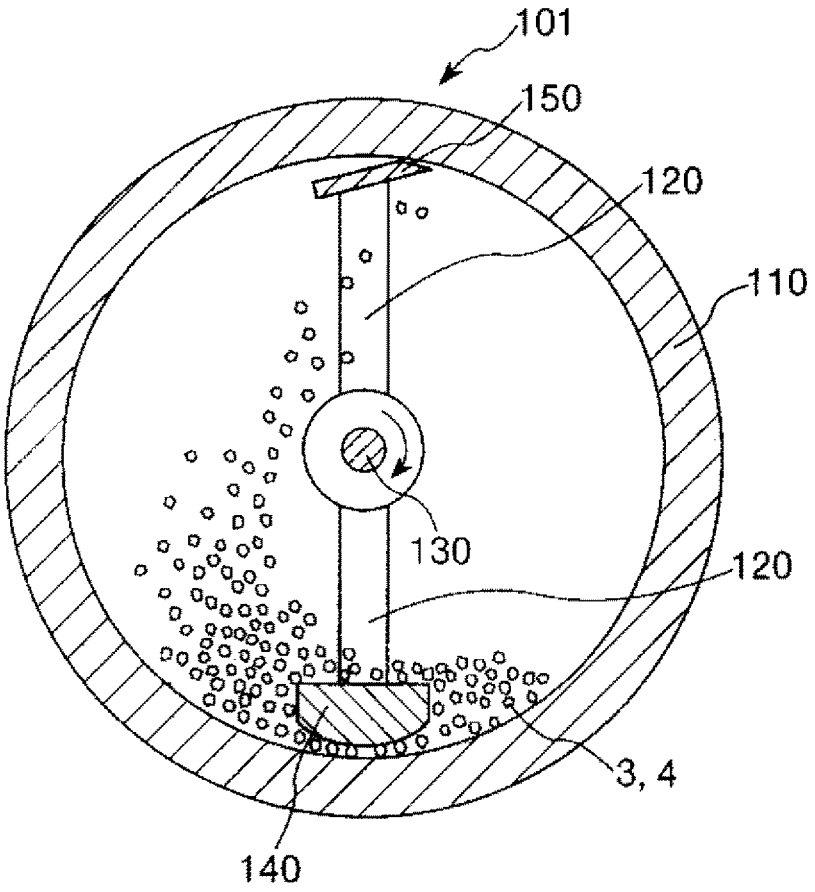
FIG. 3 is a longitudinal cross-sectional view showing a structure of the powder coating device to be used in the method for producing an insulator-coated soft magnetic powder according to the embodiment.

Here, FIG. 2 shows a state of the powder coating device 101 when the chip 140 is located on the upper side and the scraper 150 is located on the lower side, and on the other hand, FIG. 3 shows a state of the powder coating device 101 when the chip 140 is located on the lower side and the scraper 150 is located on the upper side.

The ceramic particles 3 and the glass material 4 are scraped as shown in FIG. 2 by the scraper 150. According to this, the ceramic particles 3 and the glass material 4 are lifted up with the rotation of the arm 120 and thereafter fall down, and thus are stirred.

On the other hand, as shown in FIG. 3, when the chip 140 descends, the ceramic particles 3 and the glass material 4 penetrate into a space between the chip 140 and the container 110 and are subjected to a compression action and a friction action from the chip 140 with the rotation of the arm 120.

By repeating the stirring and the compression and friction actions at a high speed, the glass material 4 is adhered to the surfaces of the ceramic particles 3. As a result, these are granulated, whereby the insulating particles 5 formed by mixing the ceramic particles 3 and the glass material 4 are obtained.

The rotation rate of the arm 120 slightly varies depending on the amount of the powder to be fed into the container 110, but is preferably set to about 300 to 1200 rotations per minute.

The pressing force when the chip 140 compresses the powder varies depending on the size of the chip 140, but is preferably, for example, about 30 to 500 N.

[2] Subsequently, the insulating particles 5 are mechanically adhered to the core particles 2. By doing this, the insulator-coated soft magnetic particles 1 are obtained.

Figure 4:
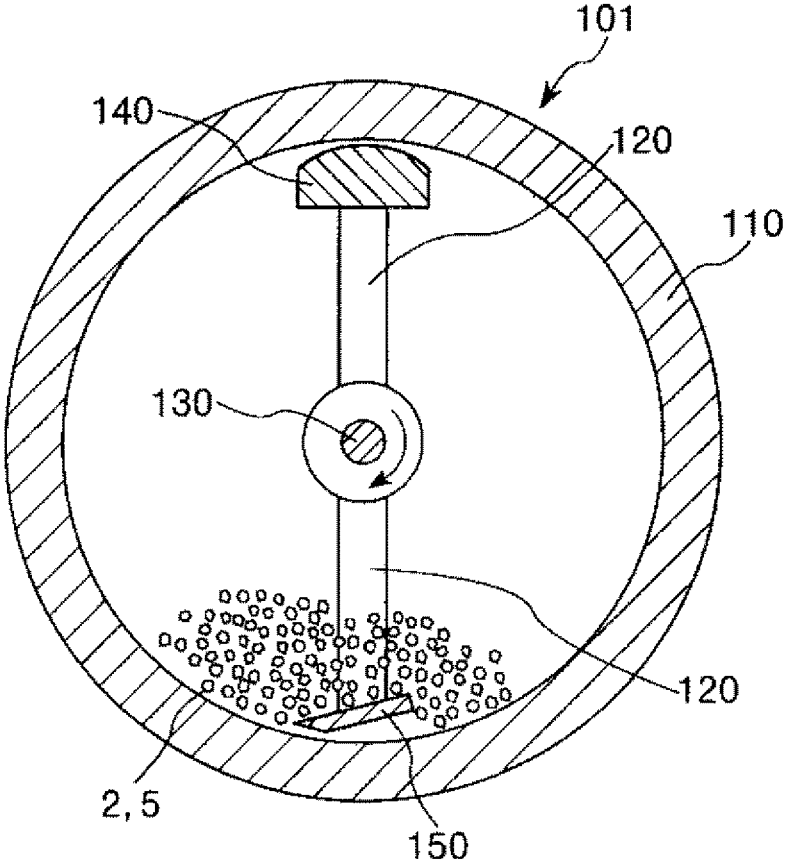
FIG. 4 is a longitudinal cross-sectional view showing a structure of the powder coating device to be used in the method for producing an insulator-coated soft magnetic powder according to the embodiment.
Figure 5:
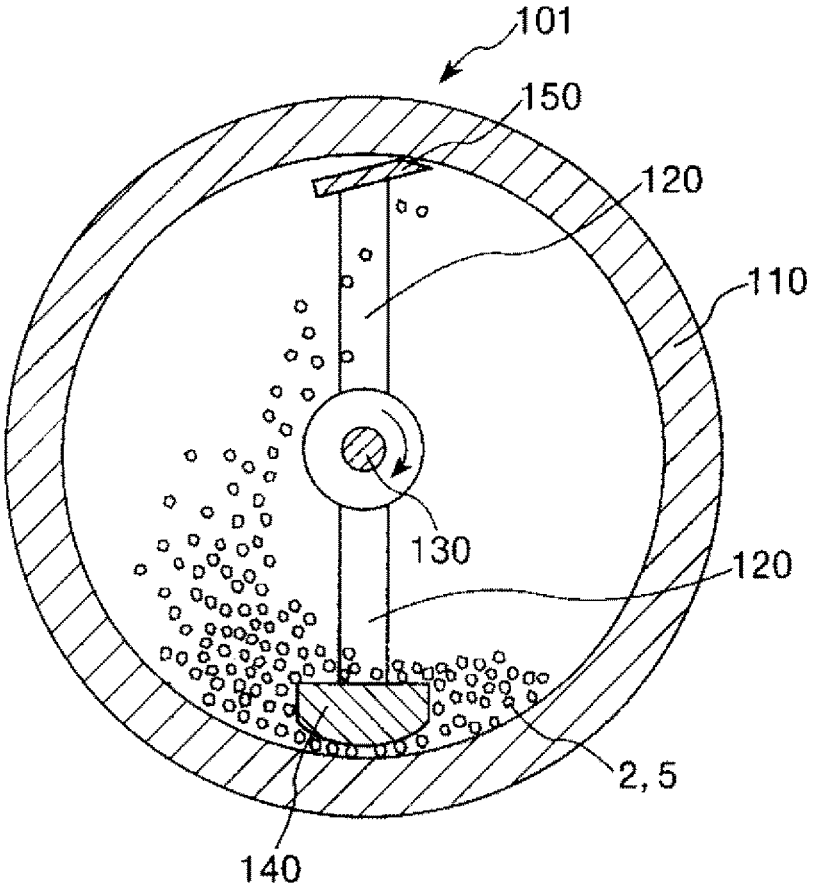
FIG. 5 is a longitudinal cross-sectional view showing a structure of the powder coating device to be used in the method for producing an insulator-coated soft magnetic powder according to the embodiment.

This mechanical adhesion is caused by pressing the insulating particles 5 against the surfaces of the core particles 2 at a high pressure. Specifically, the insulator-coated soft magnetic particles 1 are produced by causing the above-mentioned mechanical adhesion using a powder coating device 101 as shown in FIGS. 4 and 5.

Examples of a device that causes mechanical compression and friction actions on the core particles 2 and the insulating particles 5 include various types of pulverizers such as a hammer mill, a disk mill, a roller mill, a ball mill, a planetary mill, and a jet mill, and various types of friction mixers such as Angmill (registered trademark), a high-speed oval mixer, a Mix Muller (registered trademark), a Jacobson mill, Mechanofusion (registered trademark), and Hybridization (registered trademark). Here, as one example, the powder coating device 101 (friction mixer) shown in FIGS. 4 and 5 including a container 110 and a chip 140 which rotates inside the container along the inner wall of the container will be described.

The powder coating device 101 includes the container 110 which has a cylindrical shape and an arm 120 which has a rod-like shape and is provided inside the container 110 along the radial direction.

The container 110 is constituted by a metal material such as stainless steel, and mechanical compression and friction actions are given to a mixture of the core particles 2 and the insulating particles 5 fed into the container.

At the center in the longitudinal direction of the arm 120, a rotating shaft 130 is inserted, and the arm 120 is provided rotatably with this rotating shaft 130 as the center of rotation. The rotating shaft 130 is provided so as to coincide with the central axis of the container 110.

In one end portion of the arm 120, the chip 140 is provided. This chip 140 has a shape with a convex curved plane and a flat plane facing the curved plane, and the curved plane faces the inner wall of the container 110, and the separation distance between this curved plane and the container 110 is set to a predetermined length. According to this, the chip 140 can rotate along the inner wall of the container 110 with the rotation of the arm 120 while maintaining a constant distance from the inner wall.

In the other end portion of the arm 120, a scraper 150 is provided. This scraper 150 is a plate-like member, and in the same manner as the chip 140, the separation distance between the scraper 150 and the container 110 is set to a predetermined length. According to this, the scraper 150 can scrape materials near the inner wall of the container 110 with the rotation of the arm 120.

The rotating shaft 130 is connected to a rotation driving device (not shown) provided outside the container 110 and thus can rotate the arm 120.

The container 110 can maintain a sealed state while driving the powder coating device 101 and can maintain the inside in a reduced pressure (vacuum) state or a state of being replaced with any of various types of gases. The gas inside the container 110 is preferably replaced with an inert gas such as nitrogen or argon.

Next, a method for producing the insulator-coated soft magnetic particles 1 using the powder coating device 101 will be described.

First, the core particles 2 and the insulating particles 5 are fed into the container 110. Subsequently, the container 110 is sealed and the arm 120 is rotated.

Here, FIG. 4 shows a state of the powder coating device 101 when the chip 140 is located on the upper side and the scraper 150 is located on the lower side, and on the other hand, FIG. 5 shows a state of the powder coating device 101 when the chip 140 is located on the lower side and the scraper 150 is located on the upper side.

The core particles 2 and the insulating particles are scraped as shown in FIG. 4 by the scraper 150. According to this, the core particles 2 and the insulating particles 5 are lifted up with the rotation of the arm 120 and thereafter fall down, and thus are stirred.

On the other hand, as shown in FIG. 5, when the chip 140 descends, the core particles 2 and the insulating particles 5 penetrate into a space between the chip 140 and the container 110 and are subjected to a compression action and a friction action from the chip 140 with the rotation of the arm 120.

By repeating the stirring and the compression and friction actions at a high speed, the insulating particles 5 are adhered to the surfaces of the core particles 2.

The rotation rate of the arm 120 slightly varies depending on the amount of the powder to be fed into the container 110, but is preferably set to about 300 to 1200 rotations per minute.

The pressing force when the chip 140 compresses the powder varies depending on the size of the chip 140, but is preferably, for example, about 30 to 500 N.

The adhesion of the insulating particles 5 as described above can be performed under a dry condition unlike a coating method using an aqueous solution, and moreover can be performed also in an inert gas atmosphere. Therefore, there is no fear that water or the like is interposed between the core particle 2 and the insulating particle 5 during the process, and thus, the long-term durability of the insulator-coated soft magnetic particles 1 can be enhanced.

The thus obtained insulator-coated soft magnetic particles 1 may be classified as needed. Examples of the classification method include dry classification such as sieve classification, inertial classification, and centrifugal classification, and wet classification such as sedimentation classification.

In the above description, the ceramic particles 3 and the glass material 4 are mixed and also granulation is performed in advance, and thereafter, the granulated material is adhered to the surfaces of the core particles 2, however, the invention is not limited thereto, and granulation may be performed while simultaneously mixing the core particles 2, the ceramic particles 3, and the glass material 4 without performing granulation in advance.

The volume resistivity of the powder, which is an aggregate of the insulator-coated soft magnetic particles 1, when the powder is filled in a container is preferably 1 [kΩ·cm] or more and 500 [kΩ·cm] or less, more preferably 5 [kΩ·cm] or more and 300 [kΩ·cm] or less, further more preferably 10 [kΩ·cm] or more and 200 [kΩ·cm] or less. Such a volume resistivity is achieved without using an additional insulating material, and therefore is based on the insulating property between the insulator-coated soft magnetic particles 1 themselves. Therefore, when the insulator-coated soft magnetic particles 1 which achieve such a volume resistivity are used, since the insulator-coated soft magnetic particles 1 are sufficiently insulated from each other, the using amount of an additional insulating material can be reduced, and thus, the proportion of the insulator-coated soft magnetic particles 1 in a powder magnetic core or the like can be increased to the maximum by that amount. As a result, a powder magnetic core which highly achieves both high magnetic characteristics and a low loss simultaneously can be realized.

The volume resistivity described above is a value measured as follows.

First, 0.8 g of the insulator-coated soft magnetic powder to be measured is filled in a cylinder made of alumina. Then, electrodes made of brass are disposed on the upper and lower sides of the cylinder.

Then, an electrical resistance between the upper and lower electrodes is measured using a digital multimeter while applying a pressure of 10 MPa between the upper and lower electrodes using a digital force gauge.

Then, the volume resistivity is calculated by substituting the measured electrical resistance, the distance between the electrodes when applying the pressure, and the internal cross-sectional area of the cylinder into the following calculation formula.

Volume resistivity [kΩ·cm]=Electrical resistance [kΩ]×Internal cross-sectional area of cylinder [$cm^2$]/Distance between electrodes [cm]

The internal cross-sectional area of the cylinder can be obtained according to the formula: $\pi r^2$ [$cm^2$] when the inner diameter of the cylinder is represented by 2r [cm].

To the thus obtained insulator-coated soft magnetic particles 1, a heat treatment is applied as needed. By applying the heat treatment, as described above, strain remaining in the insulator-coated soft magnetic particles 1 can be removed (annealing). According to this, for example, a powder magnetic core having favorable magnetic characteristics such as coercive force can be realized.

The heat treatment temperature is appropriately set according to the type of the soft magnetic material, but is preferably 600° C. or higher and 1200° C. or lower, more preferably 800° C. or higher and 1100° C. or lower. By setting the heat treatment temperature within the above range, strain remaining in the insulator-coated soft magnetic particles 1 can be more reliably removed in a shorter time. According to this, a green compact having favorable magnetic characteristics such as magnetic permeability and coercive force can be efficiently produced.

Further, by applying the heat treatment at such a temperature before compaction molding, the insulator-coated soft magnetic particles 1 having an advantage that even when the particles are compaction molded thereafter, strain is less likely to occur, or even if strain occurs, the strain is easily removed by a simple heat treatment are obtained.

The heat treatment time is appropriately set according to the heat treatment temperature, but is preferably 30 minutes or more and 10 hours or less, more preferably 1 hour or more and 6 hours or less. By setting the heat treatment time within the above range, strain remaining in the insulator-coated soft magnetic particles 1 can be sufficiently removed.

The heat treatment atmosphere is not particularly limited, and examples thereof include an oxidizing atmosphere containing oxygen, air, or the like, a reducing atmosphere containing hydrogen, ammonia decomposition gas, or the like, an inert atmosphere containing nitrogen, argon, or the like, and a reduced-pressure atmosphere obtained by reducing the pressure of an arbitrary gas, however, the heat treatment atmosphere is preferably a reducing atmosphere, an inert atmosphere, or a reduced-pressure atmosphere, and more preferably a reducing atmosphere. According to this, an annealing treatment can be performed while suppressing an increase in the film thickness of the oxide film 2*b* of the core particle 2. As a result, the insulator-coated soft magnetic particles 1 in which the magnetic characteristics are favorable and the adhesion strength of the ceramic particles 3 is high are obtained.

Powder Magnetic Core and Magnetic Element

Next, a powder magnetic core according to this embodiment and a magnetic element according to this embodiment will be described.

The magnetic element according to this embodiment can be applied to various types of magnetic elements including a magnetic core such as a choke coil, an inductor, a noise filter, a reactor, a transformer, a motor, an actuator, an antenna, an electromagnetic wave absorber, a solenoid valve, and an electrical generator. Further, the powder magnetic core according to this embodiment can be applied to magnetic cores included in these magnetic elements.

Hereinafter, as an example of the magnetic element, two types of choke coils will be described as representatives.

First Embodiment

First, a choke coil to which a magnetic element according to a first embodiment is applied will be described.

Figure 6:
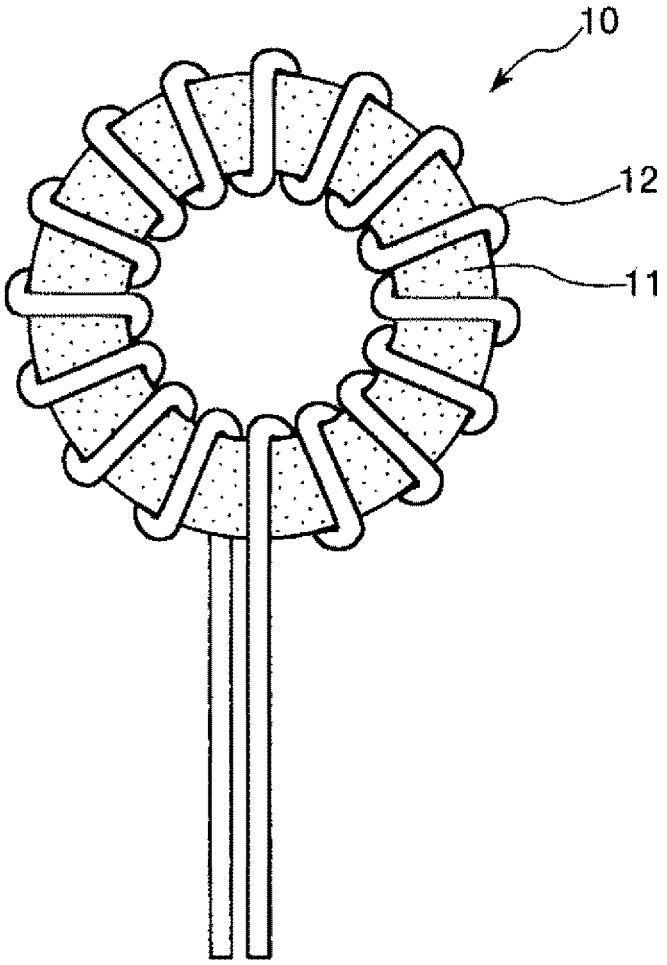
FIG. 6 is a schematic view (plan view) showing a choke coil, to which a magnetic element according to a first embodiment is applied.

FIG. 6 is a schematic view (plan view) showing the choke coil to which the magnetic element according to the first embodiment is applied.

A choke coil 10 shown in FIG. 6 includes a powder magnetic core 11 having a ring shape (toroidal shape) and a conductive wire 12 wound around the powder magnetic core 11. Such a choke coil 10 is generally referred to as "toroidal coil".

The powder magnetic core 11 is obtained by mixing the insulator-coated soft magnetic powder including the insulator-coated soft magnetic particles 1 described above, a binding material (binder), and an organic solvent, supplying the obtained mixture in a molding die, and press molding the mixture. That is, the powder magnetic core 11 includes the insulator-coated soft magnetic powder according to this embodiment. Such a powder magnetic core 11 has a favorable insulating property between particles and high heat resistance, and therefore has a low eddy current loss even at a high temperature. Further, the coercive force of the insulator-coated soft magnetic powder can be reduced by undergoing a heat treatment at a high temperature, and therefore, the hysteresis loss is reduced. As a result, a reduction in loss (improvement of magnetic characteristics) of the powder magnetic core 11 is achieved, and when the powder magnetic core 11 is mounted on an electronic device or the like, the power consumption of the electronic device or the like can be reduced or the performance thereof can be enhanced, and it can contribute to the improvement of reliability at a high temperature of the electronic device or the like.

Further, as described above, the choke coil 10 which is one example of the magnetic element includes the powder magnetic core 11. Therefore, the choke coil 10 has enhanced performance and reduced iron loss. As a result, when the choke coil 10 is mounted on an electronic device or the like, the power consumption of the electronic device or the like can be reduced or the performance thereof can be enhanced, and it can contribute to the improvement of reliability at a high temperature of the electronic device or the like.

Examples of the constituent material of the binding material to be used for producing the powder magnetic core 11 include organic materials such as a silicone-based resin, an epoxy-based resin, a phenolic resin, a polyamide-based resin, a polyimide-based resin, and a polyphenylene sulfide-based resin, and inorganic materials such as phosphates such as magnesium phosphate, calcium phosphate, zinc phosphate, manganese phosphate, and cadmium phosphate, and silicates (liquid glass) such as sodium silicate, and particularly, a thermosetting polyimide-based resin or a thermosetting epoxy-based resin is preferred. These resin materials are easily cured by heating and also have excellent heat resistance. Therefore, the ease of production of the powder magnetic core 11 and the heat resistance thereof can be enhanced.

The binding material may be used according to need and may be omitted. Even in such a case, in the insulator-coated soft magnetic powder, insulation between particles is achieved, and therefore, the occurrence of a loss accompanying the conduction of electricity between particles can be suppressed.

The ratio of the binding material to the insulator-coated soft magnetic powder slightly varies depending on the desired saturation magnetic flux density or mechanical characteristics, the allowable eddy current loss, etc. of the powder magnetic core 11 to be produced, but is preferably about 0.5 mass % or more and 5 mass % or less, more preferably about 1 mass % or more and 3 mass % or less. According to this, the powder magnetic core 11 having excellent magnetic characteristics such as saturation magnetic flux density and magnetic permeability can be obtained while sufficiently binding the particles of the insulator-coated soft magnetic powder.

The organic solvent is not particularly limited as long as it can dissolve the binding material, but examples thereof include various types of solvents such as toluene, isopropyl alcohol, acetone, methyl ethyl ketone, chloroform, and ethyl acetate.

In the above-mentioned mixture, any of various types of additives may be added for an arbitrary purpose as needed.

Examples of the constituent material of the conductive wire 12 include materials having high electrical conductivity, for example, metal materials including Cu, Al, Ag, Au, Ni, and the like.

It is preferred that on the surface of the conductive wire 12, a surface layer having an insulating property is provided. According to this, a short circuit between the powder magnetic core 11 and the conductive wire 12 can be reliably prevented. Examples of the constituent material of such a surface layer include various types of resin materials.

Next, a method for producing the choke coil 10 will be described.

First, the insulator-coated soft magnetic powder, a binding material, all sorts of necessary additives, and an organic solvent are mixed, whereby a mixture is obtained.

Subsequently, the mixture is dried to obtain a block-shaped dry material. Then, this dried material is pulverized, whereby a granulated powder is formed.

Subsequently, this granulated powder is molded into the shape of a powder magnetic core to be produced, whereby a molded body is obtained.

A molding method in this case is not particularly limited, however, examples thereof include press molding, extrusion molding, and injection molding methods. The shape and size of this molded body are determined in anticipation of shrinkage when heating the molded body in the subsequent step. Further, the molding pressure in the case of press molding is set to about 1 t/cm$^2$ (98 MPa) or more and 10 t/cm$^2$ (981 MPa) or less.

Subsequently, by heating the obtained molded body, the binding material is cured, whereby the powder magnetic core 11 is obtained. The heating temperature at this time slightly varies depending on the composition of the binding material or the like, however, in the case where the binding material is composed of an organic material, the heating temperature is set to preferably about 100° C. or higher and 500° C. or lower, more preferably about 120° C. or higher and 250° C. or lower. Further, the heating time varies depending on the heating temperature, but is set to about 0.5 hours or more and 5 hours or less.

As described above, the powder magnetic core 11 formed by press molding the insulator-coated soft magnetic powder according to this embodiment and the choke coil 10 formed by winding the conductive wire 12 around the powder magnetic core 11 along the outer peripheral face thereof are obtained.

The shape of the powder magnetic core 11 is not limited to the ring shape shown in FIG. 6, and may be, for example, a shape in which a part of a ring is missing or may be a rod shape.

The powder magnetic core 11 may contain a soft magnetic powder other than the insulator-coated soft magnetic powder according to the above-mentioned embodiment as needed. In such a case, the mixing ratio of the insulator-coated soft magnetic powder according to the embodiment to the other soft magnetic powder is not particularly limited and is set arbitrarily. Further, as the other soft magnetic powder, two or more types may be used.

Second Embodiment

Next, a choke coil to which a magnetic element according to a second embodiment is applied will be described.

Figure 7:
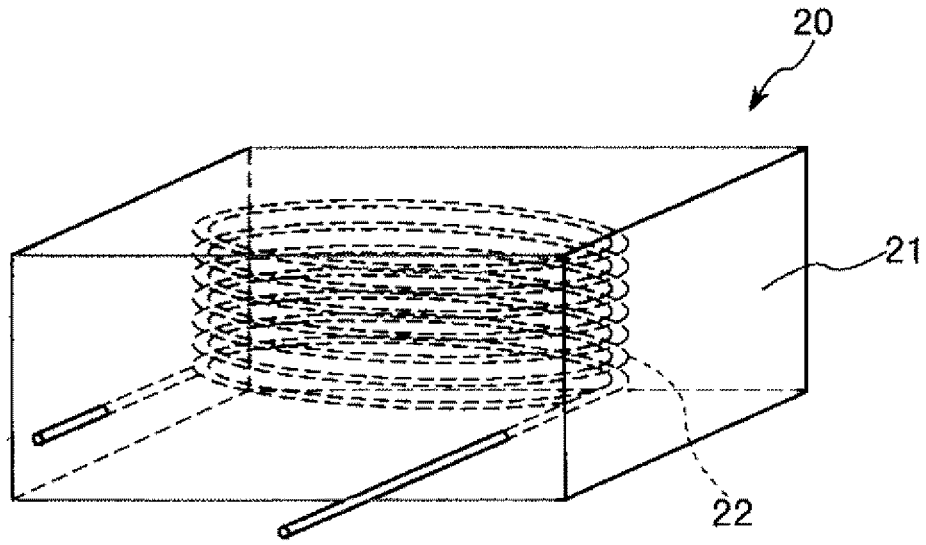
FIG. 7 is a schematic view (transparent perspective view) showing a choke coil, to which a magnetic element according to a second embodiment is applied.

FIG. 7 is a schematic view (transparent perspective view) showing the choke coil to which the magnetic element according to the second embodiment is applied.

Hereinafter, the choke coil to which the second embodiment is applied will be described, however, in the following description, different points from the choke coil to which the first embodiment is applied will be mainly described and the description of the same matter will be omitted.

A choke coil 20 shown in FIG. 7 is obtained by embedding a conductive wire 22 molded into a coil shape inside a powder magnetic core 21. That is, the choke coil 20 is obtained by molding the conductive wire 22 with the powder magnetic core 21.

According to the choke coil 20 having such a configuration, a relatively small choke coil is easily obtained. In the case where such a small choke coil 20 is produced, by using the powder magnetic core 21 having a high saturation magnetic flux density and a high magnetic permeability, and also having a low loss, the choke coil 20 which has a low loss and generates low heat so as to be able to cope with a large current although the size is small is obtained.

Further, since the conductive wire 22 is embedded inside the powder magnetic core 21, a gap is hardly generated between the conductive wire 22 and the powder magnetic core 21. According to this, vibration of the powder magnetic core 21 due to magnetostriction is suppressed, and thus, it is also possible to suppress the generation of noise accompanying this vibration.

In the case where the choke coil 20 as described above is produced, first, the conductive wire 22 is disposed in a cavity of a molding die, and also the granulated powder containing the insulator-coated soft magnetic powder is filled in the cavity. That is, the granulated powder is filled therein so as to include the conductive wire 22.

Subsequently, the granulated powder is pressed together with the conductive wire 22, whereby a molded body is obtained.

Subsequently, in the same manner as in the above-mentioned first embodiment, the obtained molded body is subjected to a heat treatment. By doing this, the binding material is cured, whereby the powder magnetic core 21 and the choke coil 20 are obtained.

The powder magnetic core 21 may contain a soft magnetic powder other than the insulator-coated soft magnetic powder according to the above-mentioned embodiment as needed. In such a case, the mixing ratio of the insulator-coated soft magnetic powder according to the embodiment to the other soft magnetic powder is not particularly limited and is set arbitrarily. Further, as the other soft magnetic powder, two or more types may be used.

Electronic Device

Next, an electronic device (an electronic device according to this embodiment) including the magnetic element according to this embodiment will be described in detail with reference to FIGS. 8 to 10.

Figure 8:
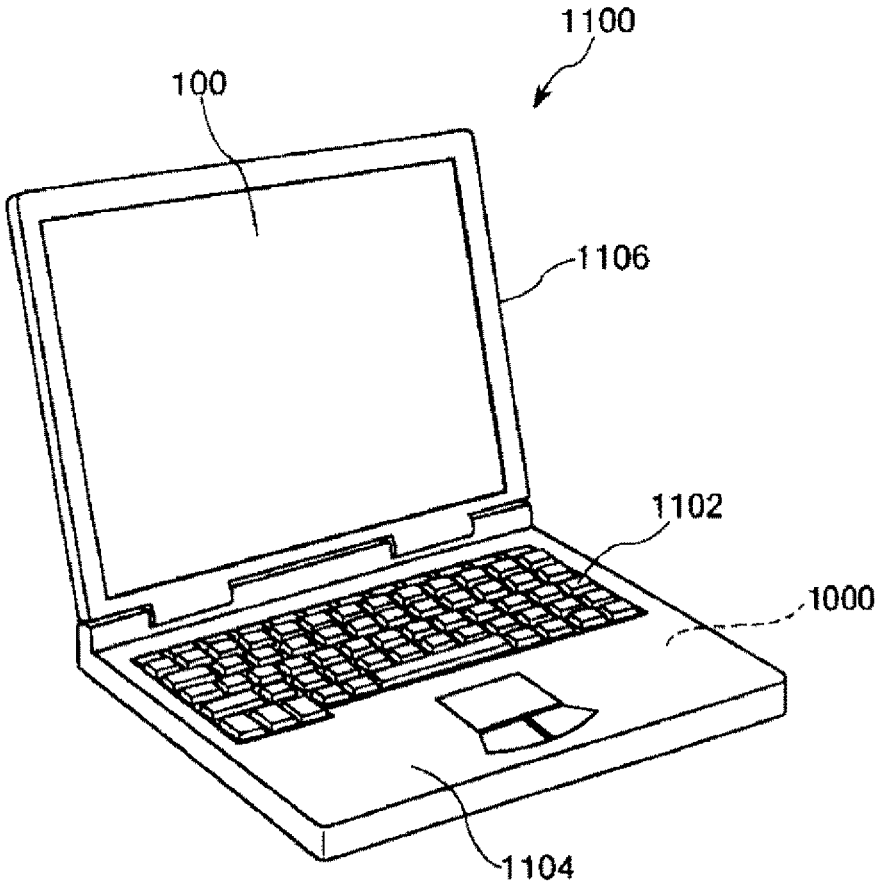
FIG. 8 is a perspective view showing a structure of a mobile (or notebook) personal computer, to which an electronic device including the magnetic element according to the embodiment is applied.

FIG. 8 is a perspective view showing a structure of a mobile (or notebook) personal computer, to which the electronic device including the magnetic element according to the embodiment is applied. In this drawing, a personal computer 1100 includes a main body 1104 provided with a key board 1102, and a display unit 1106 provided with a display section 100. The display unit 1106 is supported rotatably with respect to the main body 1104 via a hinge structure. Such a personal computer 1100 has, for example, a built-in magnetic element 1000 such as a choke coil, an inductor, or a motor for a switched-mode power supply.

Figure 9:
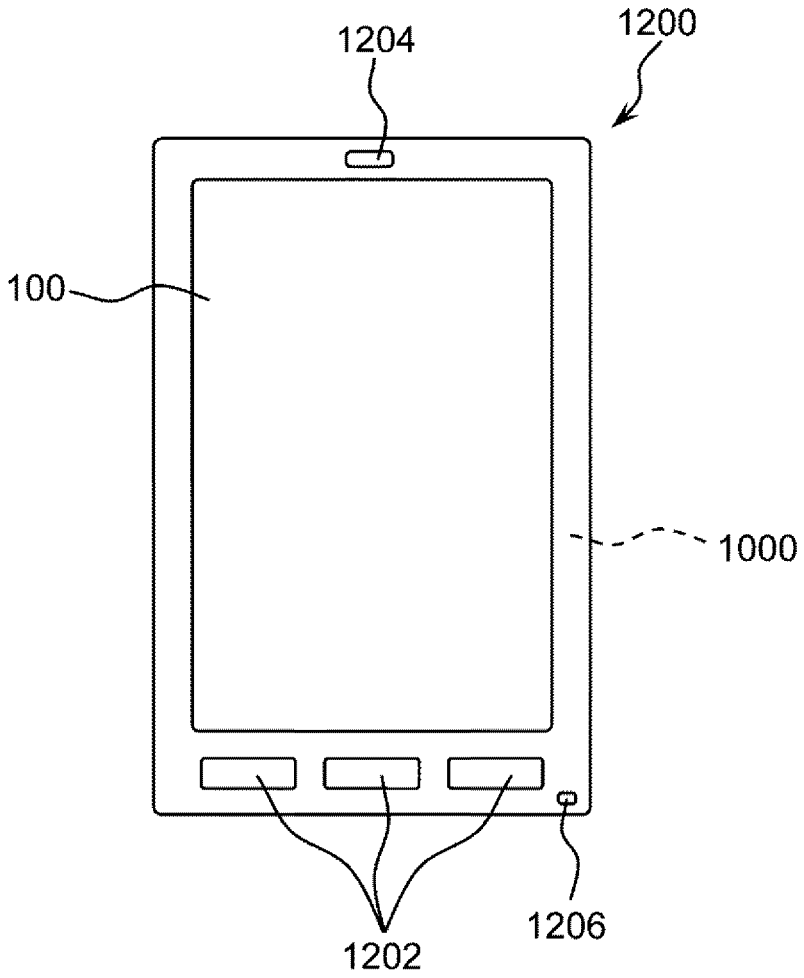
FIG. 9 is a plan view showing a structure of a smartphone, to which an electronic device including the magnetic element according to the embodiment is applied.

FIG. 9 is a plan view showing a structure of a smartphone, to which the electronic device including the magnetic element according to the embodiment is applied. In this drawing, a smartphone 1200 includes a plurality of operation buttons 1202, an earpiece 1204, and a mouthpiece 1206, and between the operation buttons 1202 and the earpiece 1204, a display section 100 is disposed. Such a smartphone 1200 has, for example, a built-in magnetic element 1000 such as an inductor, a noise filter, or a motor.

Figure 10:
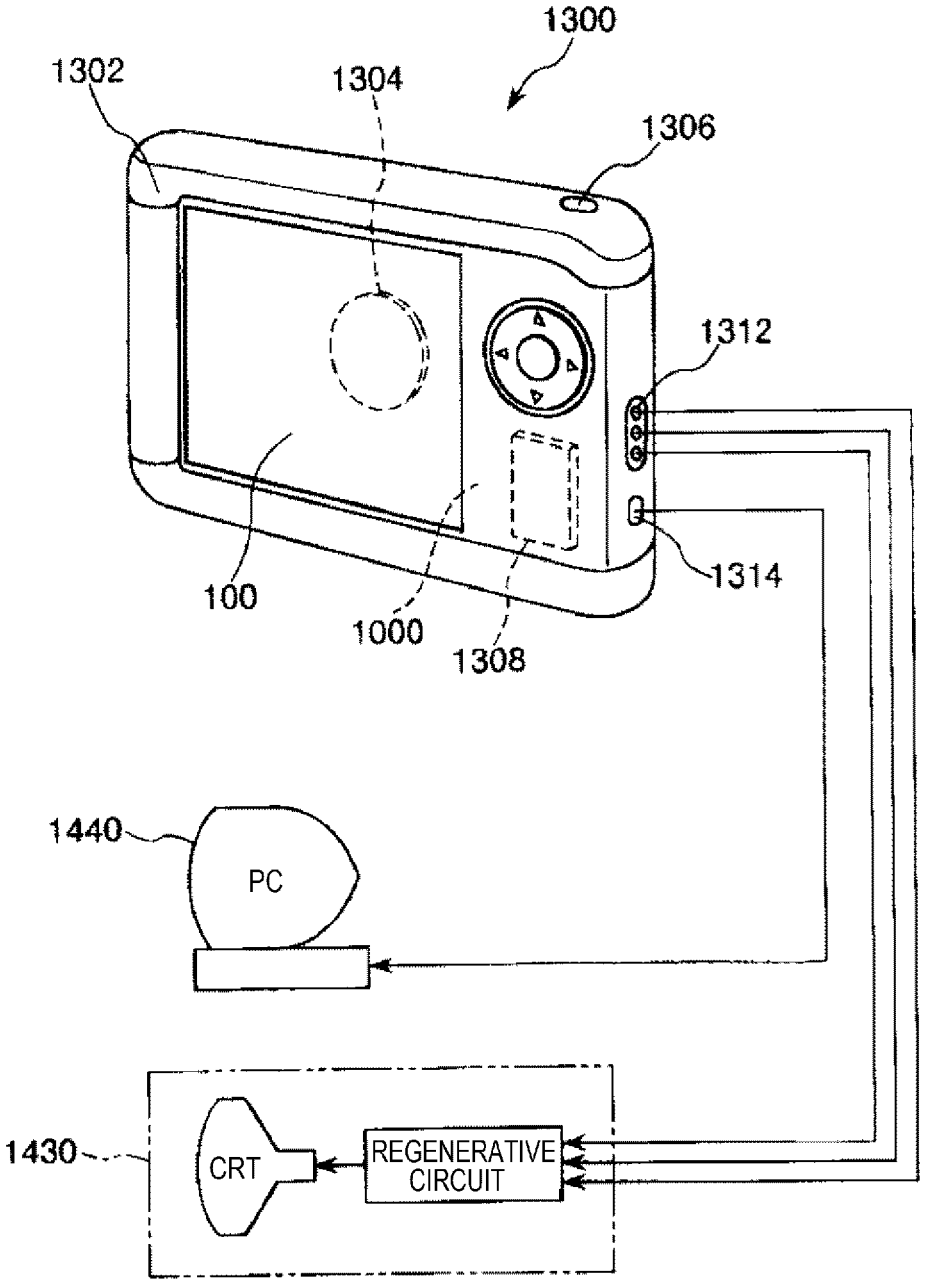
FIG. 10 is a perspective view showing a structure of a digital still camera, to which an electronic device including the magnetic element according to the embodiment is applied.

FIG. 10 is a perspective view showing a structure of a digital still camera, to which the electronic device including the magnetic element according to the embodiment is applied. In this drawing, connection to external devices is also briefly shown. A digital still camera 1300 generates an imaging signal (image signal) by photoelectrically converting an optical image of a subject by an imaging element such as a CCD (Charge Coupled Device).

On a rear face of a case (body) 1302 in the digital still camera 1300, a display section 100 is provided, and is configured to display an image taken on the basis of the imaging signal by the CCD. The display section 100 functions as a finder which displays a subject as an electronic image. Further, on the front face side (on the rear face side in the drawing) of the case 1302, a light receiving unit 1304 including an optical lens (an imaging optical system), a CCD, or the like is provided.

When a person who takes a picture confirms an image of a subject displayed on the display section 100 and pushes a shutter button 1306, an imaging signal of the CCD at that time point is transferred to a memory 1308 and stored there. Further, a video signal output terminal 1312 and an input/output terminal 1314 for data communication are provided on a side face of the case 1302 in this digital still camera 1300. As shown in the drawing, a television monitor 1430 and a personal computer 1440 are connected to the video signal output terminal 1312 and the input/output terminal 1314 for data communication, respectively, as needed. Moreover, the digital still camera 1300 is configured such that the imaging signal stored in the memory 1308 is output to the television monitor 1430 or the personal computer 1440 by a predetermined operation. Also such a digital still camera 1300 has, for example, a built-in magnetic element 1000 such as an inductor or a noise filter.

Such an electronic device includes the above-mentioned magnetic element, and therefore has excellent reliability even at a high temperature.

The electronic device according to this embodiment can be applied to, for example, cellular phones, tablet terminals, wearable terminals, timepieces, inkjet type ejection devices (for example, inkjet printers), laptop personal computers, televisions, video cameras, videotape recorders, car navigation devices, pagers, electronic notebooks (including those having a communication function), electronic dictionaries, electronic calculators, electronic gaming devices, word processors, work stations, television telephones, television monitors for crime prevention, electronic binoculars, POS terminals, medical devices (for example, electronic thermometers, blood pressure meters, blood sugar meters, electrocardiogram monitoring devices, ultrasound diagnostic devices, and electronic endoscopes), fish finders, various types of measurement devices, gauges (for example, gauges for vehicles, airplanes, and ships), vehicle control devices (for example, control devices for driving automobiles, etc.), flight simulators, and the like other than the personal computer (mobile personal computer) shown in FIG. 8, the smartphone shown in FIG. 9, and the digital still camera shown in FIG. 10.

Vehicle

Next, a vehicle (a vehicle according to this embodiment) including the magnetic element according to this embodiment will be described with reference to FIG. 11.

Figure 11:
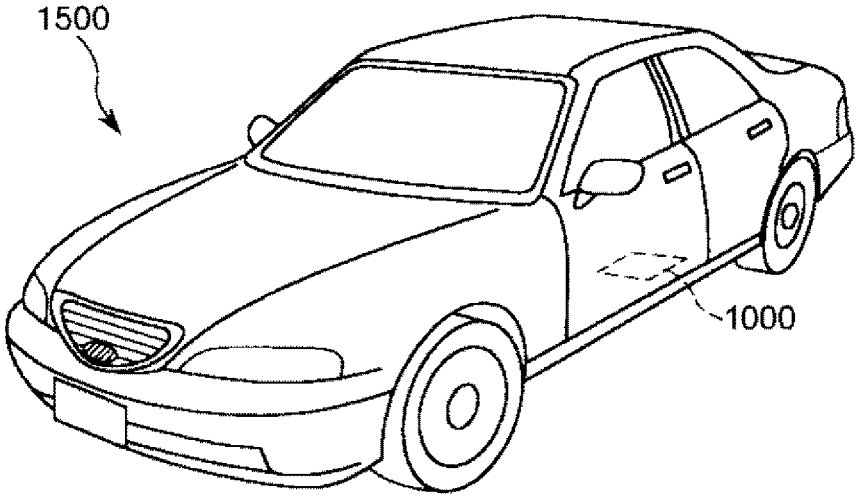
FIG. 11 is a perspective view showing an automobile, to which a vehicle including the magnetic element according to the embodiment is applied.

FIG. 11 is a perspective view showing an automobile, to which the vehicle including the magnetic element according to the embodiment is applied.

In this drawing, an automobile 1500 has a built-in magnetic element 1000. Specifically, the magnetic element 1000 is built in, for example, electronic control units such as a car navigation system, an anti-lock brake system (ABS), an engine control unit, a power control unit for hybrid automobiles or electric automobiles, a car body posture control system, and a self-driving system, and various types of automobile components such as a driving motor, a generator, an air conditioning unit, and a battery.

Such a vehicle includes the above-mentioned magnetic element, and therefore has excellent reliability even at a high temperature.

The vehicle according to this embodiment can be applied to, for example, two-wheeled vehicles, bicycles, airplanes, helicopters, drones, ships, submarines, railroad vehicles, rockets, spaceships, and the like other than the automobile shown in FIG. 11.

Hereinabove, the invention has been described based on preferred embodiments, but the invention is not limited thereto, and the configuration of each component may be replaced with an arbitrary configuration having the same function.

Further, in the invention, an arbitrary structure may be added to the above-mentioned embodiment.

Further, in the above-mentioned embodiment, as an application example of the insulator-coated soft magnetic powder according to the invention, the powder magnetic core is described, however, the application example is not limited thereto, and for example, it may be a magnetic shielding sheet or a magnetic device including a green compact such as a magnetic head.

Further, the shapes of the powder magnetic core and the magnetic element are also not limited to those shown in the drawings and may be any shapes.

EXAMPLES

Next, specific examples of the invention will be described.

1. Production of Insulator-Coated Soft Magnetic Powder

Example 1

First, a metal powder (core particles) of an Fe—Cr—Al-based alloy produced by a water atomization method was prepared. This metal powder is an Fe-based alloy soft magnetic powder containing Cr and Al. The average particle diameter of the metal powder was 10 μm.

At the same time, a ceramic powder (ceramic particles) of boron nitride (BN) was prepared. The average particle diameter of this powder was 50 nm.

Further, a $P_2O_5$-based glass powder (glass material) was prepared. The average particle diameter of this powder was 3.0 μm.

Subsequently, the metal powder, the ceramic powder, and the glass powder were fed into a friction mixer, and mechanical compression and friction actions were caused. By doing this, the ceramic powder was adhered to the surfaces of the metal particles.

Subsequently, the metal powder having the ceramic powder adhered thereto was subjected to a heat treatment, whereby an insulator-coated soft magnetic powder was obtained. The heat treatment was performed by heating at 1000° C. for 4 hours in a hydrogen atmosphere.

Examples 2 to 16

Insulator-coated soft magnetic powders were obtained in the same manner as in Example 1 except that the production conditions were changed as shown in Table 1, 2, or 3.

Comparative Examples 1 to 3

Insulator-coated soft magnetic powders were obtained in the same manner as in Examples 1, 9, and 10 except that a metal powder of an Fe—Cr—Al-based alloy produced by a gas atomization method was used.

When the presence or absence of an oxide film was confirmed with respect to the used metal powder, the presence of an oxide film was not confirmed.

Comparative Examples 4 and 5

Insulator-coated soft magnetic powders were obtained in the same manner as in Example 1 except that the ceramic powder was omitted and also the production conditions were changed as shown in Table 2. The addition amounts of the glass powders in the insulator-coated soft magnetic powders were set to 0.76 mass % and 2.24 mass %, respectively.

Comparative Examples 6 to 8

Insulator-coated soft magnetic powders were obtained in the same manner as in Example 1 except that the production conditions were changed as shown in Table 2 or 3.

Reference Example

An insulator-coated soft magnetic powder was obtained in the same manner as in Example 1 except that the formation of the insulator layer was omitted.

2. Evaluation of Insulator-Coated Soft Magnetic Powder 2.1. Measurement of Magnetic Permeability of Insulator-Coated Soft Magnetic Powder With respect to each of green compacts of the insulator-coated soft magnetic powders obtained in the respective Examples, Comparative Examples, and Reference Example, the magnetic permeability was measured under the following measurement conditions.

Measurement Conditions for Magnetic Permeability

Measurement device: impedance analyzer (HEWLETT PACKARD 4194A)

Measurement frequency: 100 kHz

Number of turns of coil wire: 7

Diameter of coil wire: 0.5 mm

The measurement results are shown in Tables 1 to 3.

2.2. Measurement of Electrical Breakdown Voltage of Insulator-Coated Soft Magnetic Powder Each of the insulator-coated soft magnetic powders (2 g) obtained in the respective Examples, Comparative Examples, and Reference Example was filled in a cylindrical container made of alumina with an inner diameter of 8 mm. Then, electrodes made of brass were disposed on the upper and lower sides of the container.

Subsequently, a pressure of 40 kg/cm$^2$ was applied between the upper and lower electrodes using a digital force gauge.

Subsequently, while applying the load, a voltage of 50 V was applied between the upper and lower electrodes for 2 seconds at normal temperature (25° C.), and an electrical resistance between the electrodes was measured using a digital multimeter.

Subsequently, the voltage was increased to 100 V and applied for 2 seconds, and an electrical resistance between the electrodes was measured again.

Thereafter, an electrical resistance between the electrodes was repeatedly measured while increasing the voltage to 200 V, 250 V, 300 V, and so on, in increments of 50 V. The increase in the voltage and the measurement were repeated until an electrical breakdown occurred.

In the case where an electrical breakdown did not occur even when the voltage was increased to 1000 V, the measurement was finished at that time.

The above measurement was performed 3 times each while changing the powder to a new one, and the smallest measurement value is shown in Tables 1 to 3.

TABLE 1

| | | | Unit | Example 1 | Example 2 | Example 3 | Example 4 | Example 5 | Example 6 | Example 7 | Example 8 | Example 9 |
|---|---|---|---|---|---|---|---|---|---|---|---|---|
| Production conditions for insulator-coated soft magnetic powder | Core particles | Type of base portion | — | Fe—Cr—Al-based alloy | | | | | | | | |
| | | Oxide contained in oxide film | — | $SiO_2$ | $SiO_2$ | $SiO_2$ | $SiO_2$ | $SiO_2$ | $SiO_2$ | $SiO_2$ | $SiO_2$ | $SiO_2$ |
| | | Thickness of oxide film | nm | 40 | 40 | 40 | 40 | 40 | 40 | 50 | 50 | 50 |
| | Ceramic particles | Type of ceramic powder | — | BN | BN | BN | BN | BN | BN | $Al_2O_3$ | $Al_2O_3$ $SiO_2$ | $Al_2O_3$ |
| | | Average particle diameter of ceramic powder | nm | 50 | 50 | 50 | 100 | 700 | 50 | 18 | 18 | 27 |
| | | Addition amount of ceramic powder | mass % | 0.27 | 0.36 | 0.40 | 0.32 | 0.56 | 0.36 | 0.25 | 0.32 | 0.40 |
| | Glass material | Type of glass powder | — | $P_2O_5$-based glass | $P_2O_5$-based glass | $P_2O_5$-based glass | $P_2O_5$-based glass | $P_2O_5$-based glass | $Bi_2O_3$-based glass | $P_2O_5$-based glass | $P_2O_5$-based glass | $Bi_2O_3$-based glass |
| | | Average particle diameter of glass powder | μm | 3.0 | 3.0 | 3.0 | 3.0 | 3.0 | 1.0 | 3.0 | 3.0 | 1.0 |
| | Ratio of ceramic particles to glass material | | vol % | 100 | 200 | 300 | 200 | 400 | 250 | 150 | 250 | 300 |
| Evaluation results of insulator-coated soft magnetic powder | Magnetic permeability | | — | 33.0 | 32.0 | 31.0 | 30.0 | 29.0 | 32.5 | 32.5 | 30.5 | 31.5 |
| | Electrical breakdown voltage | | V | 800 | 1000 | 1000 | 900 | 500 | 1000 | 900 | 1000 | 1000 |

TABLE 2

| | | | Unit | Example 10 | Example 11 | Comparative Example 1 | Comparative Example 2 | Comparative Example 3 | Comparative Example 4 | Comparative Example 5 | Comparative Example 6 | Comparative Example 7 | Reference Example |
|---|---|---|---|---|---|---|---|---|---|---|---|---|---|
| Production conditions for insulator-coated soft magnetic powder | Core particles | Type of base portion | — | Fe—Cr—Al-based alloy | | | | | | | | | |
| | | Oxide contained in oxide film | — | $SiO_2$ | $SiO_2$ | | | | $SiO_2$ | $SiO_2$ | $SiO_2$ | $SiO_2$ | $SiO_2$ |
| | | Thickness of oxide film | nm | 60 | 60 | 0 | 0 | 0 | 40 | 40 | 40 | 40 | 40 |
| | Ceramic particles | Type of ceramic powder | — | $SiO_2$ | $SiO_2$ | BN | $Al_2O_3$ | $SiO_2$ | | | BN | BN | |
| | | | — | | | | | | | | | | |
| | | Average particle diameter of ceramic powder | nm | 40 | 100 | 50 | 27 | 40 | | | 50 | 50 | |
| | | Addition amount of ceramic powder | mass % | 0.25 | 0.40 | 0.27 | 0.85 | 0.59 | | | 0.12 | 2.50 | |
| | Glass material | Type of glass powder | — | $P_2O_5$-based glass | $Bi_2O_3$-based glass | | | | $P_2O_5$-based glass | $Bi_2O_3$-based glass | $P_2O_5$-based glass | $P_2O_5$-based glass | |
| | | Average particle diameter of glass powder | μm | 3.0 | 1.0 | | | | 3.0 | 1.0 | 3.0 | 1.0 | |
| | Ratio of ceramic particles to glass material | | vol % | 200 | 300 | | | | | | 50 | 600 | |
| Evaluation results of insulator-coated soft magnetic powder | Magnetic permeability | | — | 32.0 | 31.0 | 33.0 | 28.0 | 26.0 | 31.5 | 28.5 | 31.5 | 24.0 | 35.0 |
| | Electrical breakdown voltage | | V | 900 | 1000 | 50 | 200 | 100 | 150 | 200 | 50 | 500 | 0 |

TABLE 3

| | | | Unit | Example 12 | Example 13 | Comparative Example 8 | Example 14 | Example 15 | Example 16 |
|---|---|---|---|---|---|---|---|---|---|
| Production conditions for insulator-coated soft magnetic powder | Core particles | Type of base portion | — | Fe—Cr—Al-based alloy | | | Fe—Si—Cr-based alloy | | |
| | | Oxide contained in oxide film | — | $SiO_2$ | $SiO_2$ | $SiO_2$ | $SiO_2$ | $SiO_2$ | $SiO_2$ |
| | | Thickness of oxide film | nm | 40 | 40 | 40 | 50 | 50 | 50 |
| | Ceramic particles | Type of ceramic powder | — | $Al_2O_3$ | $Al_2O_3$ | $Al_2O_3$ | $Al_2O_3$ | $Al_2O_3$ | $Al_2O_3$ |
| | | Average particle diameter of ceramic powder | nm | 18 | 18 | 18 | 18 | 18 | 18 |
| | | Addition amount of ceramic powder | mass % | 1.29 | 1.72 | 2.58 | 0.59 | 0.86 | 1.29 |
| | Glass material | Type of glass powder | — | $P_2O_5$-based glass | $P_2O_5$-based glass | $P_2O_5$-based glass | $P_2O_5$-based glass | $P_2O_5$-based glass | $P_2O_5$-based glass |
| | | Average particle diameter of glass powder | μm | 3.0 | 3.0 | 3.0 | 3.0 | 3.0 | 3.0 |
| | Ratio of ceramic particles to glass material | | vol % | 450 | 500 | 600 | 350 | 400 | 450 |
| Evaluation results of insulator-coated soft magnetic powder | Magnetic permeability | | — | 29.0 | 28.5 | 24.0 | 30.0 | 29.5 | 29.0 |
| | Electrical breakdown voltage | | V | 300 | 500 | 500 | 400 | 500 | 500 |

As apparent from Tables 1 to 3, it was confirmed that the insulator-coated soft magnetic powders of the respective Examples showed good results for both the magnetic permeability of the green compact and the electrical breakdown voltage as compared with the insulator-coated soft magnetic powders of the respective Comparative Examples and Reference Example.

The entire disclosure of Japanese Patent Application No. 2018-035894 filed Feb. 28, 2018 is expressly incorporated herein by reference.

What is claimed is:

1. An insulator-coated soft magnetic powder, comprising:

core particles each of which includes a base portion containing a soft magnetic material and an oxide film provided on the surface of the base portion and containing an oxide of an element contained in the soft magnetic material;

ceramic particles which are provided on the surface of each of the core particles and have an insulating property; and a glass layer that encapsulates the surface of each of the core particles, has an insulating property, and contains at least one type of phosphorus oxide, bismuth oxide, zinc oxide, boron oxide, tellurium oxide, and silicon oxide as a main component, wherein the ceramic particles are dispersed throughout the glass layer that encapsulates the surface of each of the core particles, the ceramic particles are included in a proportion of 100 vol % or more and 500 vol % or less of the glass layer, and have an average particle diameter that is 1 nm or more and 500 nm or less, a thickness of the glass layer that encapsulates the surface of the core particles is greater than the average particle diameter of the ceramic particles, and wherein the ceramic particles contain aluminum oxide or zirconium oxide.

2. The insulator-coated soft magnetic powder according to claim 1, wherein the oxide film has a thickness of 5 nm or more and 200 nm or less.

3. The insulator-coated soft magnetic powder according to claim 1, wherein the core particles are a water atomized powder or a spinning water atomized powder.

4. A powder magnetic core, comprising the insulator-coated soft magnetic powder according to claim 1.

5. A magnetic element, comprising the powder magnetic core according to claim 4.

6. An electronic device, comprising the magnetic element according to claim 5.

7. A vehicle, comprising the magnetic element according to claim 5.

* * * * *